US007740518B2

(12) United States Patent
Elliott

(10) Patent No.: US 7,740,518 B2
(45) Date of Patent: Jun. 22, 2010

(54) JOUSTING TOY

(76) Inventor: Michael Elliott, P.O. Box 1932, Renton, WA (US) 98057

( * ) Notice: Subject to any disclaimer, the term of this patent is extended or adjusted under 35 U.S.C. 154(b) by 661 days.

(21) Appl. No.: 11/611,016

(22) Filed: Dec. 14, 2006

(65) Prior Publication Data

US 2007/0205554 A1 Sep. 6, 2007

Related U.S. Application Data

(60) Provisional application No. 60/779,991, filed on Mar. 6, 2006.

(51) Int. Cl.
*A63H 1/00* (2006.01)

(52) U.S. Cl. ..... 446/256; 446/236; 446/257; 446/263; 446/234; 446/235; 446/237; 446/268; 446/259; 446/246; 446/247; 446/251; 273/126 R; 273/443; D21/710; D21/460; D21/461; D21/462; D21/463; D21/464

(58) Field of Classification Search ..... 273/126 R, 273/443; D21/710, 460–464; 446/256, 259, 446/234–237, 246, 247, 251, 257, 263, 268
See application file for complete search history.

(56) References Cited

U.S. PATENT DOCUMENTS

| | | | | | |
|---|---|---|---|---|---|
| 896,628 | A | * | 8/1908 | Davenport | 446/217 |
| 1,537,312 | A | * | 5/1925 | Korona | 446/216 |
| D156,773 | S | * | 1/1950 | Schaper | D21/455 |
| 2,633,664 | A | * | 4/1953 | Neilson | 446/257 |
| 2,727,744 | A | * | 12/1955 | Watson | 473/588 |
| 2,839,869 | A | * | 6/1958 | Lopez | 446/69 |
| 2,879,066 | A | * | 3/1959 | Sutherland | 273/147 |
| 2,937,025 | A | * | 5/1960 | Bellak | 273/440.1 |
| 3,191,341 | A | * | 6/1965 | Martin | 446/264 |
| 3,220,744 | A | * | 11/1965 | Gomory et al. | 180/65.1 |
| 3,316,672 | A | * | 5/1967 | Dixon | 446/258 |
| 3,323,491 | A | * | 6/1967 | Granick | 118/506 |
| 3,703,011 | A | * | 11/1972 | Goggi et al. | 114/346 |
| 3,762,711 | A | * | 10/1973 | Cooper | 273/126 R |
| 3,876,205 | A | * | 4/1975 | Drohomirecky | 273/359 |
| 3,897,952 | A | * | 8/1975 | Breslow | 273/122 R |
| 4,218,062 | A | * | 8/1980 | Brooks, Jr. | 273/108 |
| 4,251,949 | A | * | 2/1981 | Buck et al. | 446/444 |
| 4,274,629 | A | * | 6/1981 | Ferris et al. | 273/440 |
| 4,335,876 | A | * | 6/1982 | Westernoff | 273/447 |
| 4,772,241 | A | * | 9/1988 | Bro et al. | 446/202 |
| 4,932,918 | A | * | 6/1990 | Onoda | 446/260 |
| 5,020,798 | A | * | 6/1991 | Yang | 273/440 |
| 5,026,057 | A | * | 6/1991 | Watford | 273/108.1 |
| D323,369 | S | * | 1/1992 | De Masi et al. | D21/710 |
| 5,234,216 | A | * | 8/1993 | Ostendorff | 273/127 A |
| 5,683,284 | A | * | 11/1997 | Christen | 446/233 |
| 5,718,648 | A | * | 2/1998 | La Savio | 473/588 |

(Continued)

*Primary Examiner*—Gene Kim
*Assistant Examiner*—Alexander R Niconovich
(74) *Attorney, Agent, or Firm*—Jellett Law ps.

(57) ABSTRACT

A jousting element for use in a game. The jousting element has a body which is arranged around a cylindrically aligned vertical axis. The body is configured to rotate about the vertical axis and to be carried above a playing surface. A traveling component connected to the body enables the body of the jousting element to be carried above the playing surface along multiple directions of travel. Attached to the body is a first playing component. The first playing component enables the jousting element to engage a second jousting element.

21 Claims, 13 Drawing Sheets

U.S. PATENT DOCUMENTS 5,733,213 A * 3/1998 Colarusso ..... 473/588
5,823,845 A * 10/1998 O'Berrigan ..... 446/234
5,827,107 A * 10/1998 Bears et al. ..... 446/263
5,996,998 A * 12/1999 Przybilla ..... 273/147
6,083,076 A * 7/2000 Saint-Victor ..... 446/242
6,332,616 B1 * 12/2001 Brown ..... 273/440.1
6,530,817 B1 * 3/2003 Winslow et al. ..... 446/256
6,607,420 B2 * 8/2003 Chung ..... 446/235
6,739,939 B2 * 5/2004 Matsukawa ..... 446/256
6,776,680 B2 * 8/2004 Chow ..... 446/247
6,905,389 B2 * 6/2005 Matsukawa ..... 446/256
6,918,590 B2 * 7/2005 Annis et al. ..... 273/289
7,037,169 B2 * 5/2006 Benedek et al. ..... 446/242
7,104,543 B2 * 9/2006 Wilk et al. ..... 273/288
7,281,714 B2 * 10/2007 Wilk et al. ..... 273/288
7,290,767 B2 * 11/2007 Wilk et al. ..... 273/288
2002/0102907 A1 * 8/2002 Osawa ..... 446/256
2003/0064660 A1 * 4/2003 Matsukawa ..... 446/256
2003/0199222 A1 * 10/2003 Matsukawa et al. ..... 446/256
2004/0051244 A1 * 3/2004 Weisman ..... 273/262
2004/0198153 A1 * 10/2004 Halpin et al. ..... 446/259
2005/0070203 A1 * 3/2005 Beckett ..... 446/259
2005/0142983 A1 * 6/2005 Matsukawa et al. ..... 446/246
2007/0021029 A1 * 1/2007 Weidetz et al. ..... 446/256

* cited by examiner

JOUSTING TOY

RELATED APPLICATIONS

This application claims priority benefit of U.S. Ser. No. 60/779,991, filed Mar. 6, 2006.

BACKGROUND

Background Art

U.S. Pat. No. 6,918,590 discloses a figure with spinner in base, where in the Summary of the Invention section in col. 1 starting at line 62, "the present invention is concerned with providing a toy figure for use in playing a game comprising a figure representing a character appropriate to the game to be played. The figure is mounted upon a base having an upper surface, an opposed bottom wall, at least one side wall extending at least partially between the upper surface and bottom wall, which has an upper inside surface. There is an access opening in the sidewall of the base. A rotatable disk is substantially contained within the base. The disk has an upper face, as the disk is disposed in the base, an opposed underside, and a wall extending at least partially between the upper face and the underside. A segment of at least the peripheral wall is exposed in the access opening in the side wall facilitating spinning or rotation of the disk by the user's thumb or finger . . . a viewing opening or window in the upper surface of the base permits viewing of the entirety of only a single sector on the disk. The underside of the disk has a face ratchet, and an upwardly biased pall on the upper, inside surface of bottom wall of the base which cooperates with the face ratchet to provide for the viewing of the entirety of only one of the sectors of the disk to the viewing opening in the upper surface in the base."

U.S. Pat. No. 6,776,680 discloses a handheld toy spinning apparatus and associated method of play. In the Summary of the Invention section starting at col. 1 around line 45, "the present invention is a toy assembly and its associated method of play. The toy assembly includes a hub. Two holes are disposed in the hub though which a looped string is passed. By winding the string and then pulling the string taut, the string can be caused to rapidly unwind, thus rotating the hub. A removable housing is connected to the hub. The housing has a release mechanism. When the release mechanism is engaged, the housing disk engages from the hub. Two players face each other and utilize their toy assemblies to cause their hubs and surrounding housings to turn. The turning housings are then brought to battle by creating contact between the spinning housings. If one housing contacts the release mechanism on another housing, the housing on the contacted toy will separate from the hub and become disabled."

U.S. Pat. No. 6,739,939 discloses a toy top game unit. The unit has a driving means to rotate the toy top, a game board for receiving the toy top, as well as interacting means between the toy top and the game board such as magnets on the toy top and on the game board to provide a change in the operational mode of the toy top. In the Summary of the Invention section, as seen in col. 1 around line 43, "an object of the present invention to . . . provide a toy top game unit in which operational modes can be changed without the spinning toy tops being influenced by players directly or indirectly . . . " Further down in col. 1 around line 48, "according to a first aspect of the present invention, [the] toy top, [has a] driving means for rotating said toy top, a game board for receiving said toy top, and means for interacting the toy top and the game board, and for imparting change to an operational mode of the toy top on said game board, said interacting means including first magnet means arranged on the toy top and second magnet means arranged on the game board."

U.S. Pat. No. 6,332,616 discloses a jousting game, where two pieces which each include a body portion, a shield and other segments which connect to the body portion and where the two pieces can be placed on a track structure at opposite respective ends for movement towards each other along respective paths of movement. In the Summary of the Invention section in col. 1 around line 11, "a first aspect of the invention is . . . a track structure having first and second ends and defining first and second paths of movement . . . , first and second playing pieces which can be placed on the track structure at the first and second ends respectively for movement along the first and second paths of movement respectively, each playing piece including a body portion, a shield member having at least two hinged segments attached to the body portion, a first control mechanism operable to select one of the hinged segments as a blocked segment, a projecting element attached to the body portion and having a raised position and at least two lowered positions, and a second control mechanism operable to select one of the lowered positions as an active position."

U.S. Pat. No. 5,234,216 discloses a toy vehicle crash simulating play set. The play set has a support base to which a pair of toy vehicles are pivotally secured in a space apart arrangement. In the Summary of the Invention section in col. 3 around line five, "a more loss of major system components and which is relatively inexpensive to manufacture. [The] present invention . . . comprises a support base, a pair of pivoting toy vehicles pivotally supported on the base in a spaced apart arrangement, spring means urging the pivoting toy vehicles pivotal direction away from the base, and latch means restraining the pivoting toy vehicles in the spaced apart arrangement upon the base . . . "

U.S. Pat. No. 4,335,876 discloses a jousting game, which includes a number of ring support assemblies, a corresponding number of rings, and a jousting arm assembly. A jousting arm assembly includes a saddle clamp, a pivot mounting clamp, a jousting arm collar, a control lever, and an L-shaped jousting arm. The jousting arm assembly is releasably mounted on the handlebar of a bike.

U.S. Pat. No. 4,251,949 discloses a toy track and bowl with car height indicator. In the Summary of the Invention section in col. 1 around line 48, "the . . . objects of the invention are [:] . . . a toy racing apparatus [which has] a first portion of a steeply inclined track capable of imparting substantial speed to a gravity-powered vehicle placed thereon and a second portion which comprises, in a preferred embodiment, a frusto-conical bowl-like portion which increases in diameter from its base to its top. The gravity-powered vehicle leaves the incline track, enters the base of the frusto-conical portion at a high speed. The vehicle travels in a spiral path therein progressing from the base upwardly until it reaches its maximum height, at which time it falls back into the base of frusto-conical portion."

U.S. Pat. No. 3,897,952 discloses a skill type projectile game, which has two opposed playing areas and a launching device for each playing area. Each area is operable by individual players of the game for propelling a ball towards one of a plurality of common, movable targets located between playing areas. As seen in the Summary of the Invention section in col. 1 around line 32, "[the] invention includes a combination of a plurality of launchable objects or balls, a game board having two opposing playing areas, each playing area having at least one launching station for receiving at least one of said launchable objects. A divider is mounted between the playing areas and a plurality of movable hammer shapes or movable hammer shaped targets are pivotally mounted on the divider and movable about pivotable axis from back and forth between playing areas in response to being struck by a ball."

EMBODIMENTS

Figure 1:
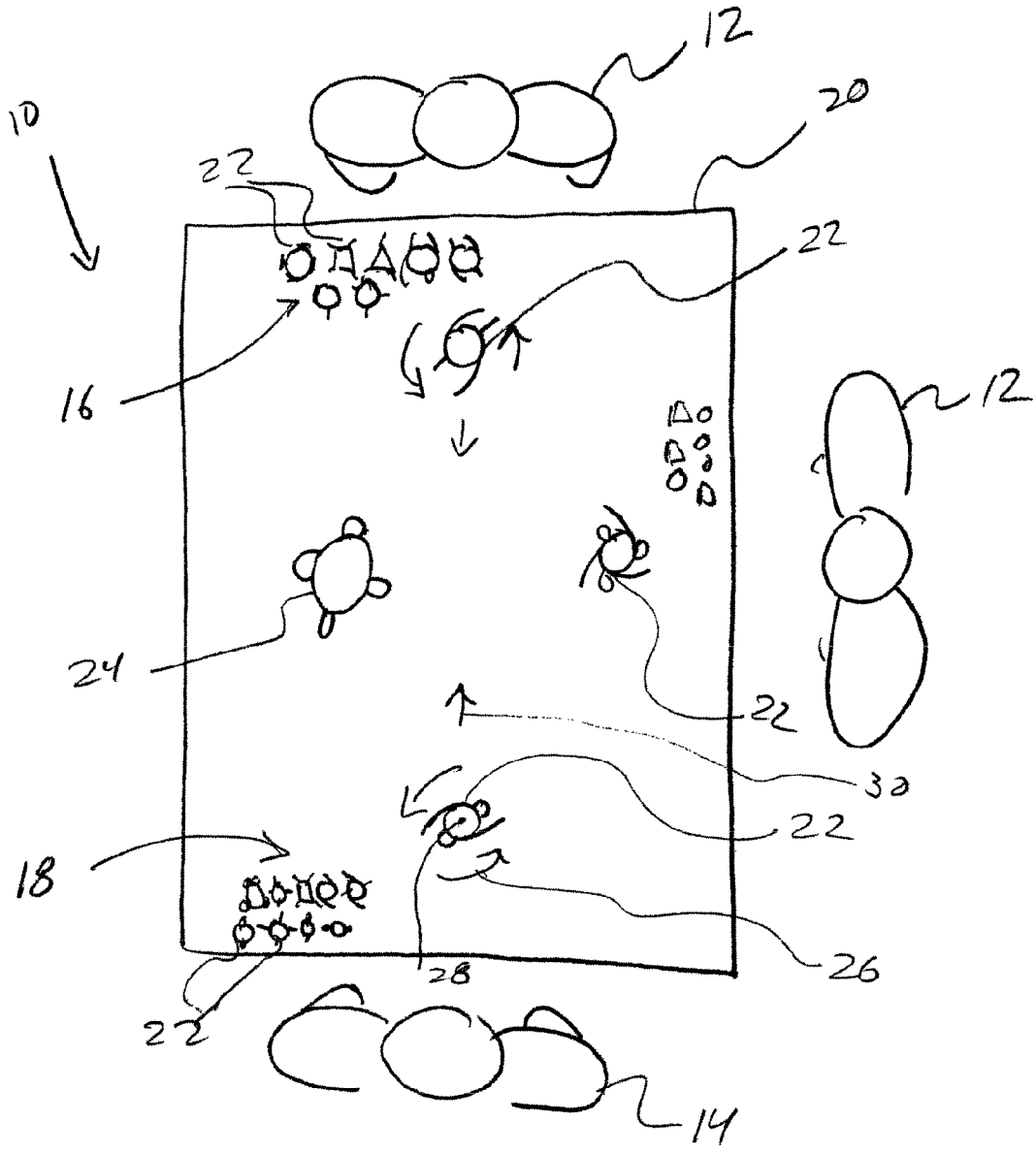
FIG. 1 is a plan view of the jousting system.

Referring to FIG. 1, a jousting system 10 is shown arranged within a playing field 20. In the current embodiment, the jousting system 10 is shown with a first jousting team 16 and a second jousting team 18. An additional jousting team is on the sidelines, and can take part in the play depending on the game play roles as adopted by the players.

The jousting system 10 has the following game pieces. Other pieces can also be included depending on the desired functionality and game play the players adopt. A playing field 20 is used to provide for a playing field environment in which the jousting elements or bodies 22 can interact. The playing field includes a flat horizontal planar surface; it can also include a track surface, the playing field can be a playing space, which has three-dimensional trajectory characteristics where the jousting elements 22 can be placed for example on a stick of some sort and moved in three-dimensional spatial relation to one another. Also, the playing field 20 can include concave semispherical surfaces and the like which provide for ejecting the jousting elements 22 into the semispherical spatial surface allowing them to revolve around one another in a roulette style arrangement until they collide when the orbiting bodies 22 or jousting elements 22 have a small enough orbital radius to interact with one another and collide.

Still referring to FIG. 1, a discussion of the overall game play will be provided. Each player starts with a team of jousting elements 22. In this first embodiment (as seen in FIG. 1), the first player 12 has a first jousting team 16 which includes a plurality of jousting elements 22 of various characteristics and configurations. The second player 14 also has a second jousting team 18 which includes a plurality of jousting elements 22 or jousting bodies 22. They also are of varying characteristics and configurations. A third player is shown on the sidelines with his jousting team.

The first player 12 and the second player 14 each select a jousting element 22 for a jousting session or face off. The players spin their jousting bodies 22 and launch them towards each other. The launching is in a longitudinally aligned engagement trajectory 30. This is generally within the desired playing field 20, which in the current embodiment is a horizontal surface.

As the jousting bodies 22 collide, if one jousting body captures the other jousting body then the one player owner of the jousting body who captures the other player's jousting body scores points. The particular method and apparatus through which the capturing or scoring of points occurs will be discussed below. If no points are scored, then the two jousting bodies 22 are reset and another joust is attempted. If this results in a tie of scores, then the players go to a sudden-death play option. In the sudden-death play option, the losing player determined to go first, has the option of sliding his jousting body towards the opponent's jousting body 22 which is in a stationary position. If the first player misses, the roles are switched. This is similar to a sudden-death game play which occurs during a shootout match in a soccer game for example. If the first player misses, the roles are switched. If neither wins two rounds of sudden-death, each player scores a point and the players move on to the next pair of jousting figures to compete. In the first embodiment, the game is played to seven points or however many points the players determine to go, using the number of figures.

Figure 2:
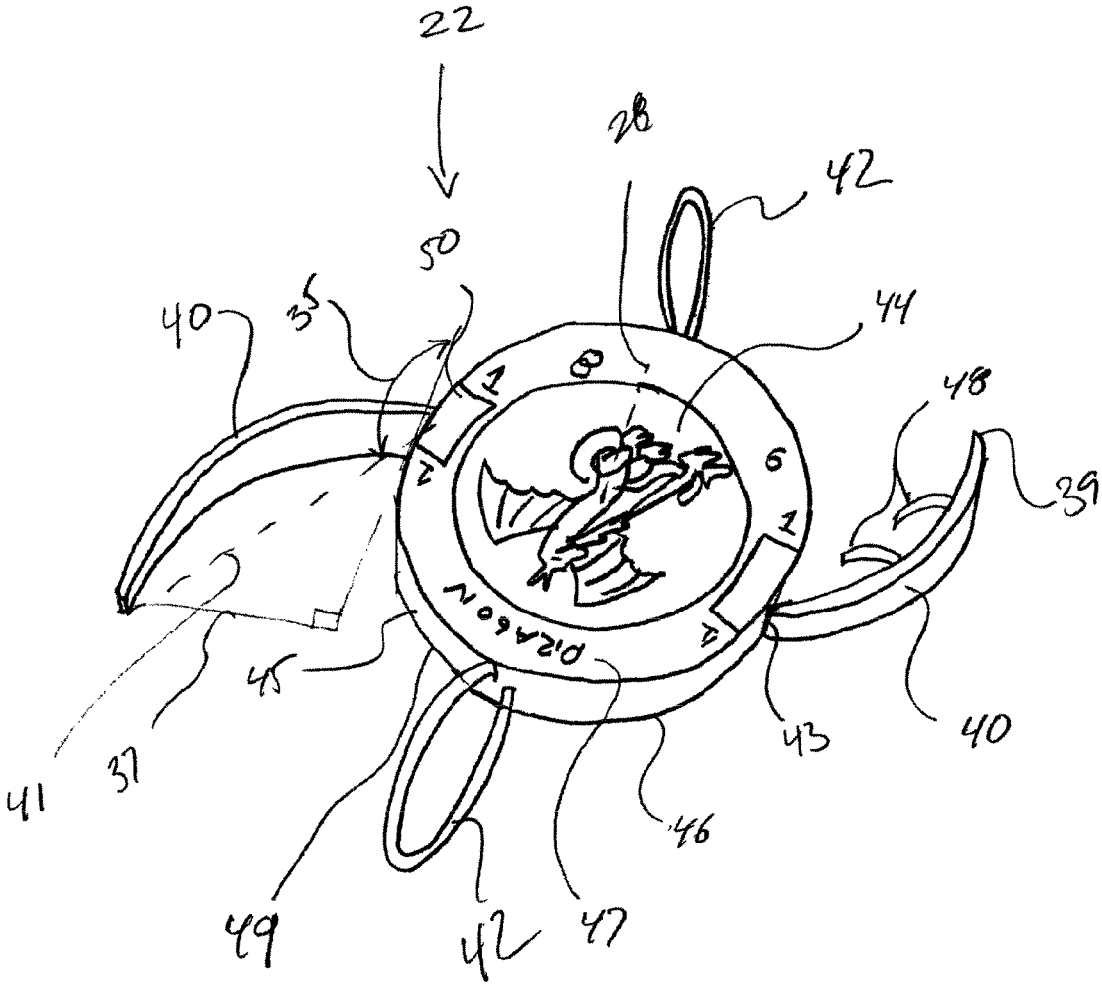
FIG. 2 is a perspective detail view of a jousting element.

In order to score points and detract points, as well as to attack and defend, the jousting bodies 22, as seen in FIG. 2 in this first embodiment have a number of weapon elements and target elements.

The first embodiment of a body section or jousting body 46 is in a cylindrical configuration or shaped as a circular disc. In this first embodiment, the outer diameter of the disc is approximately 1.8 inches. The disc is constructed alternatively of a plurality of materials such as foam, polyvinyl chloride, wood, metal, or other plastic type material. The disc has a height in this current embodiment of approximately ½ inch, but other heights are readily conceived and are discussed below.

In addition to the cylindrical configuration of the jousting element or body section, other various volumetric shapes can be utilized in combination or individually including a semi-spherical shape, a cubic shape, a pyramidical shape, or a semi cylindrical shape.

The weapon elements 40 are attached to the outer diameter surface 45 in a tangential orientation. The weapon elements 40 in this first embodiment are diametrically opposed to one another and each is formed as a spiral hooked configuration extending out a finite circumferential arc length from the connection point 43 to the tip 39. From the connection 43 to the tip 39 is a cord distance 41. The cord distance 41 has a radial leg distance 37 of approximately 7/10 of an inch and a tangential arc distance 35 of approximately 215°.

The target element 42 in this first embodiment is a closed loop wire frame hoop body which extends substantially radially outwards from the outer diameter surface 45 of the jousting body 46. In this first embodiment, the jousting body 46 has two target elements 42, which are also diametrically opposed to one another and are essentially 90° from the previously-mentioned diametrically opposed weapon elements 40 on a quadrant axis.

The target elements 42 are designed so that an opposing jousting body 22 having weapon elements 40 arranged in a similar vertically aligned horizontal plane as the target elements 42, can on occasion during a joust collision, hook into the target elements 42 and score a point with the weapon element on that particular jousting body.

The jousting body 46 in this first embodiment has an upper surface or top surface 47 and a bottom surface 49. In this first embodiment, the top surface 47 has a character image 44 imprinted on the top surface of the jousting body representing the type of jousting body 22. Also arranged on the top surface 47 are score or point fields 50 as well as other character indicia for providing game play information. The weapon elements 40 are operatively disconnectable from the joust body 46 outer diameter surface 45 and can be interchanged with other weapon elements. One manner of doing this is through a threaded body and threaded receiving type arrangement, another method of providing the connection is through a clip-type connection, where if the weapon elements 40 experience a strong collision with another jousting element or body 22, then the weapon element 40 could be dislodged or detached and the player would lose points for the loss of a weapon.

Figure 2A:
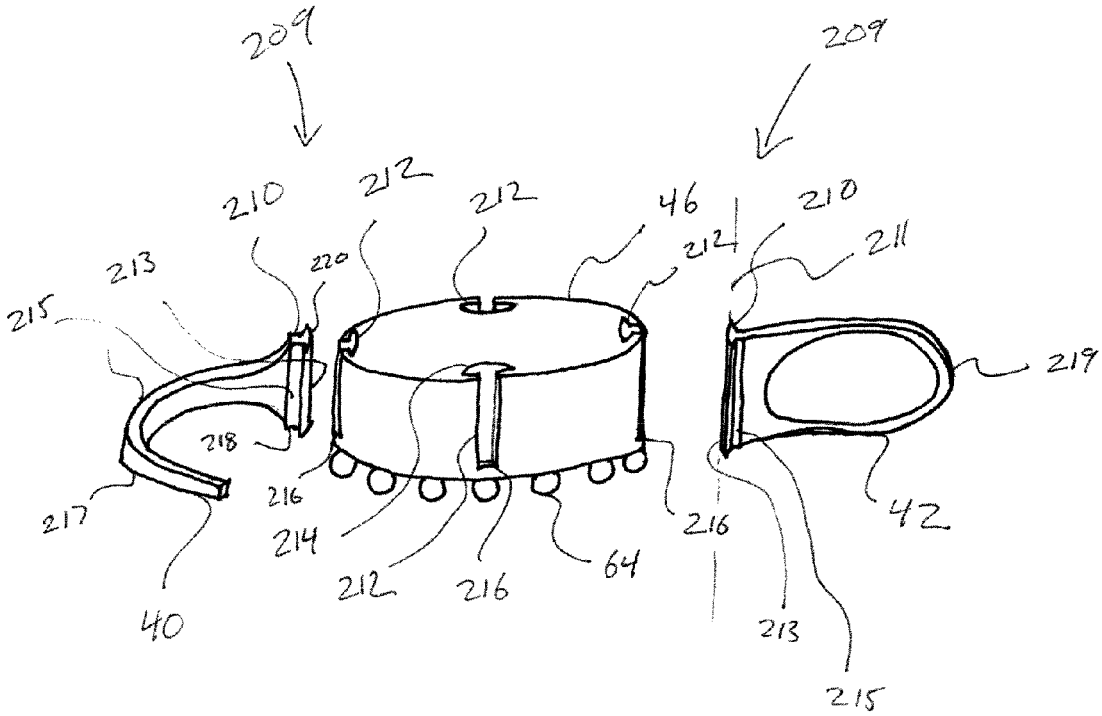
FIG. 2A is a perspective detail view of an alternative embodiment of a jousting element.

Referring to FIG. 2A, an alternative embodiment of the jousting body 46 utilizing a set of interchangeable playing components 209 will now be discussed. In this particular embodiment, the jousting body 46 is still arranged as a cylindrical volumetric shaft, with a plurality of vertically aligned locking channels 212 arranged around the perimeter edge of the cylindrical jousting body 46. These locking channels interoperate with longitudinally aligned shaft elements 210 which are arranged along a longitudinal component axis 211. The interchangeable playing components 209 include for example a target element 42 or a weapon element or component 40. In this particular embodiment, the weapon component 40 is shaped in the previously mentioned curvilinear arm fashion 217. The curvilinear arm 217 originates from the longitudinally aligned shaft element 210. The shaft element 210 is designed so that it can lock into the vertically aligned locking channel 212 and be seated within the shaft resting on a channel seat 216. The shaft element 210 has, in this particular embodiment, two main elements, a rectilinear protrusion section 215 which connects the semicircular target 219 or the curvilinear arm 217 to the shaft element locking section 213. The shaft element and locking section 213 has a cross-sectional profile which is larger than the rectilinear protrusion section 215 which thus retains the locking section 213 with the female locking channel 214 which is an area substantially matching and is slightly larger than the cross-sectional area of the locking section 213.

Multiple interchangeable playing components, therefore, can be placed within the female locking channel 214 and utilized during the game. Additionally, orientation of, say for example, the curvilinear arm 217 can be reversed from, say for example, a clockwise pointing curvilinear arm or in other words a positive moment orientation, to a counter clockwise pointing curvilinear arm or in other words a negative moment orientation about the central axis 28 of the jousting body or body section 46.

Figure 3:
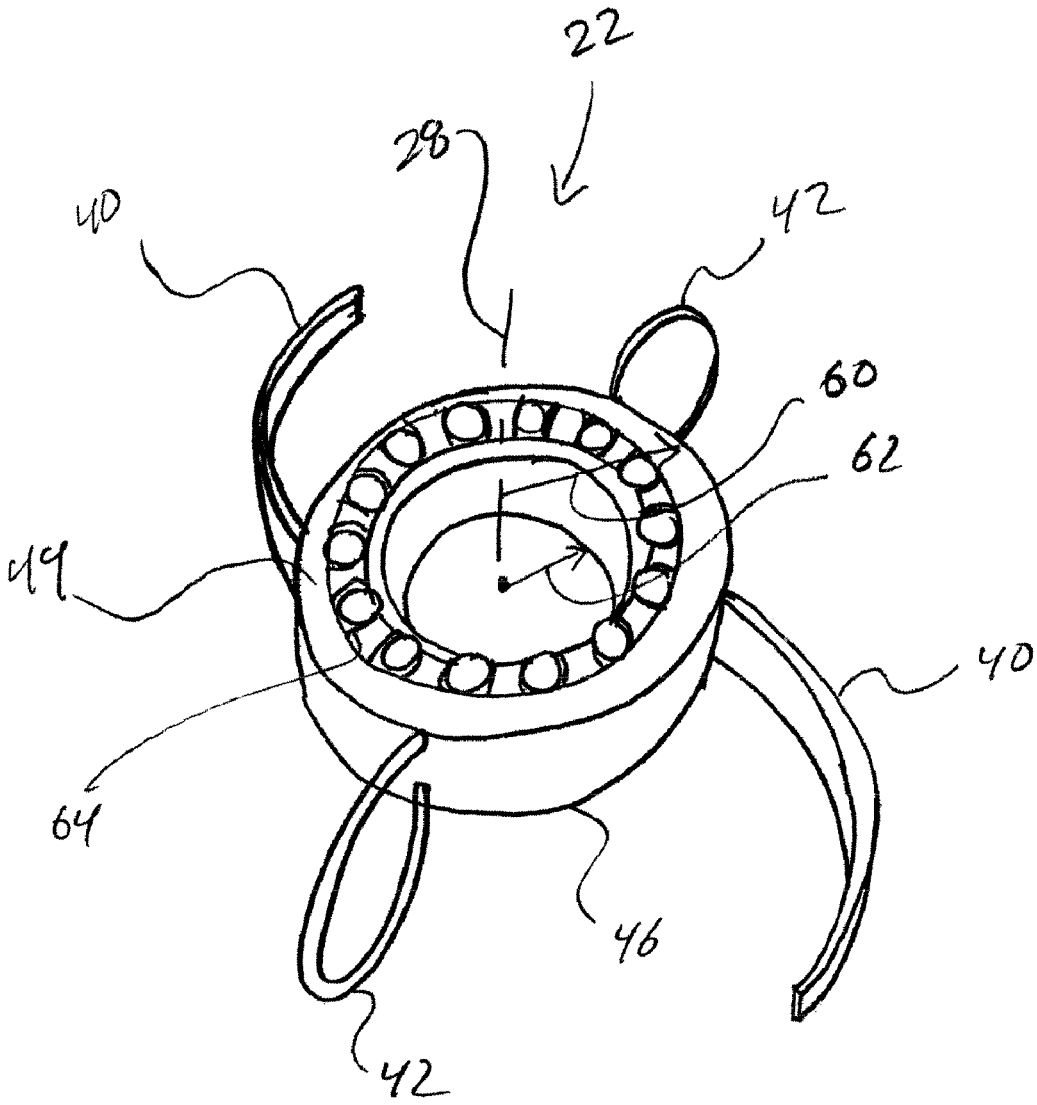
FIG. 3 is a perspective bottom detail view of a jousting element.

To provide for travel over the horizontal plane, a traveling element 64 as seen in FIG. 3 is positioned on the bottom plane of the jousting body 22. The mechanics of the game play require the jousting body 22 to be spun about its centrally aligned axis 28 and concurrently to be launched in a longitudinally aligned trajectory 30 as seen in FIG. 1 with the intent of colliding with a game piece, and scoring on a target.

To accomplish the spinning and launching, the travel element 64 provides multidirectional travel capabilities through the use of, in the first embodiment, bearings placed in a circular manner about the central axis 28 of jousting body 22. In this first embodiment, there are 5-6 ball bearings, in a metal configuration with or without a ring housing. More bearings can also be utilized with at least three (3) bearings providing a stable footing on the playing surface. Other travel elements will be discussed below. Briefly, the travel elements can include laterally aligned wheels on a vertically aligned rotatable hinge to provide for change in direction as well as a travel element which reduces the frictional resistance between the player surface and the jousting body 22. The travel element can be a shell with a Teflon outer surface to reduce friction during travel. The shell itself can be on rails or can be semi-spherical convex. The element could also be a cushion of air between the surface of a table and the jousting element, such as used in air hockey tables.

Figure 4:
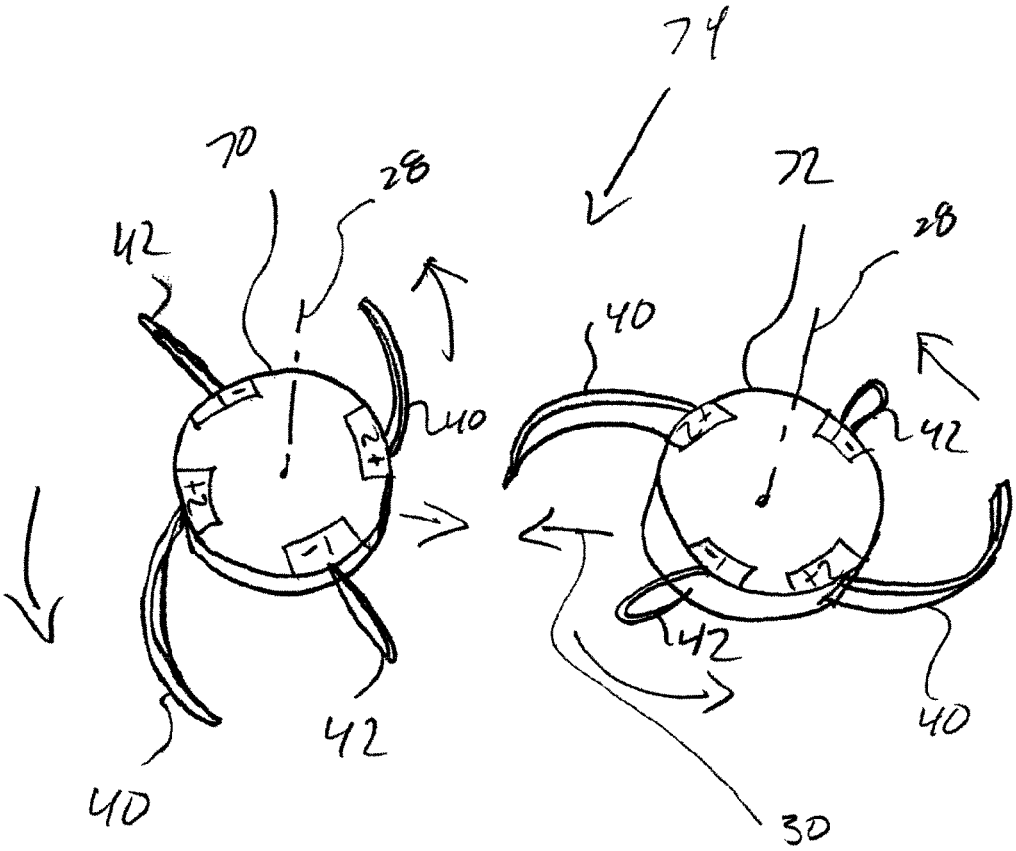
FIG. 4 is a schematic view of the jousting elements in a pre-collision engagement.
Figure 5:
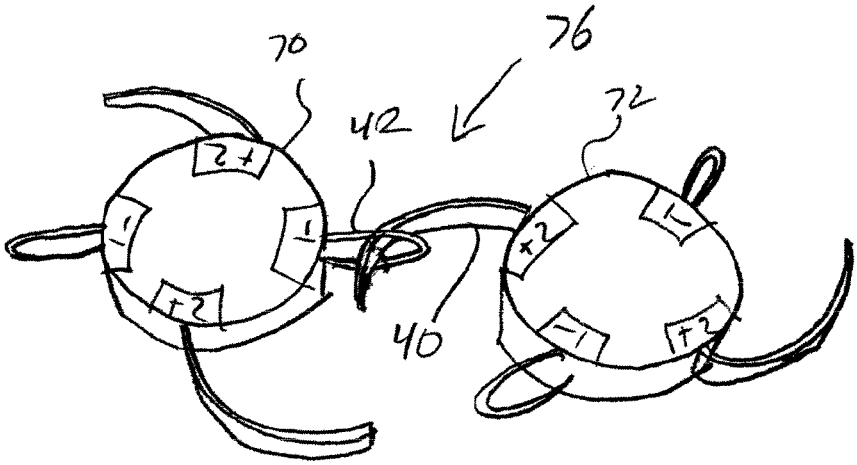
FIG. 5 is a schematic view of the jousting elements in a collision engagement.

Referring to FIGS. 4 and 5, a detailed discussion of a jousting section resulting in a score will now be provided. First referring to FIG. 4, a pre-collision engagement is shown where a first jousting element 70 and a second jousting element 72 have been launched towards one another along a longitudinally aligned trajectory 30 and are each spinning about their central axes 28, thus providing for opportunities to score or hook onto each other's respective target elements 42 using their weapon elements 40.

Because the spin action about the central axes 28 is somewhat random, and the longitudinal trajectory paths 30 are somewhat inaccurate, it is difficult to predict the outcome of the scoring. This unpredictability adds to the excitement of the game. In this particular embodiment, as seen in FIG. 5, a second jousting element 72 after the two bodies have collided, has scored a direct hit on first jousting element 70 by hooking second jousting element's weapon 40 onto first jousting element's target 42, which is the hoop. This results in a field score 50 of two points for the second jousting element 72 and a detraction of one point for the first jousting element 70 as shown in the first jousting element's field score 50 at the target location.

Figure 6:
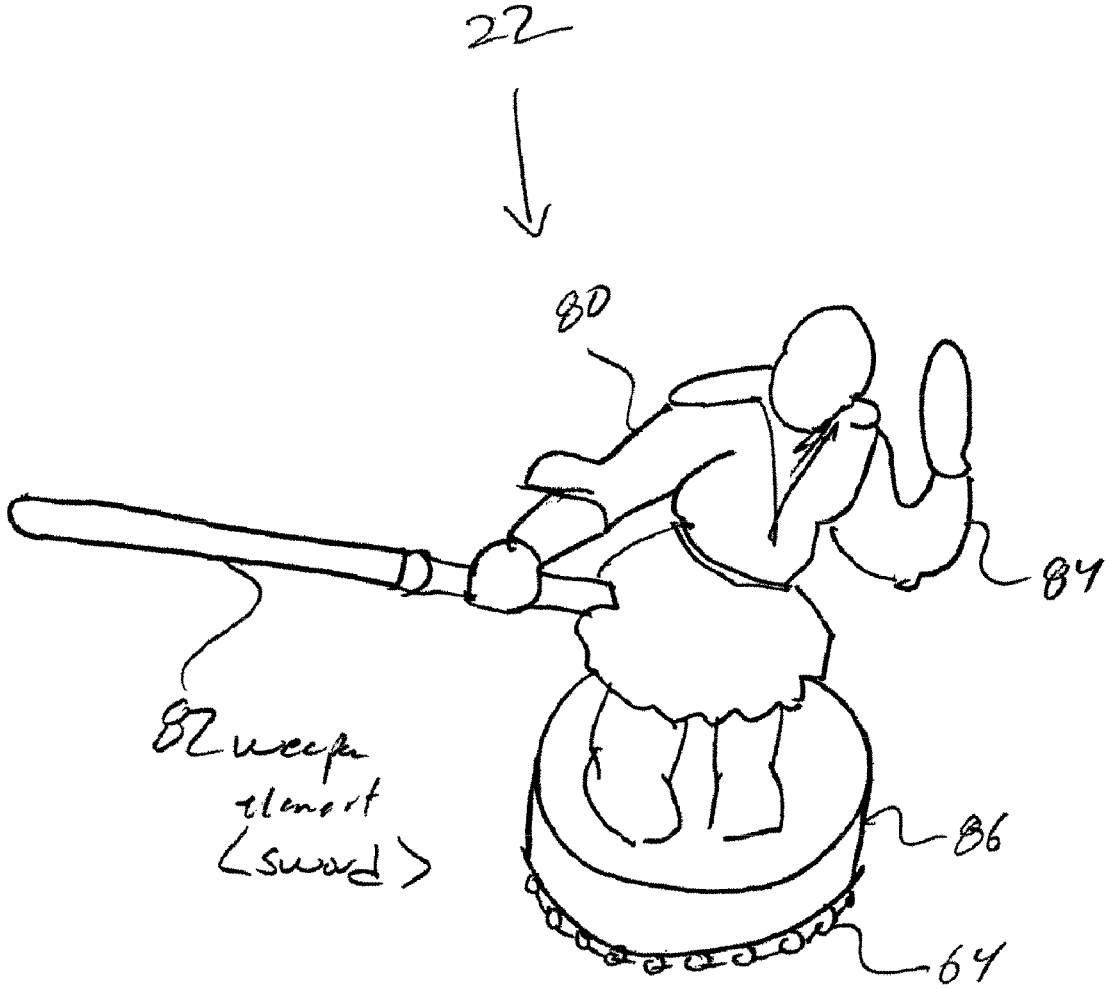
FIG. 6 is a perspective detail view of an alternative embodiment of a jousting element.

A second embodiment of the jousting element 22 as seen in FIG. 6 includes a miniature FIG. 80 which in this embodiment is an action figure representative of some line of action figures either in a movie, cartoon, or other related child entertainment production. In this embodiment, the miniature FIG. 80 has a weapon element 82 which is a sword and a target or shield element 84, which in this embodiment is just the miniature figure's left hand. The figure is attached to a disc-shaped base 86, which in the previous embodiment was the joust body 46. The base 86 provides for adequate anchoring of the miniature FIG. 80 in an upright position so that the miniature figure can be spun as well as launched in its' desired trajectories. The second embodiment also has a travel element 64 which it similar to the previously discussed travel playing field 20 as seen in FIG. 1.

Figure 7:
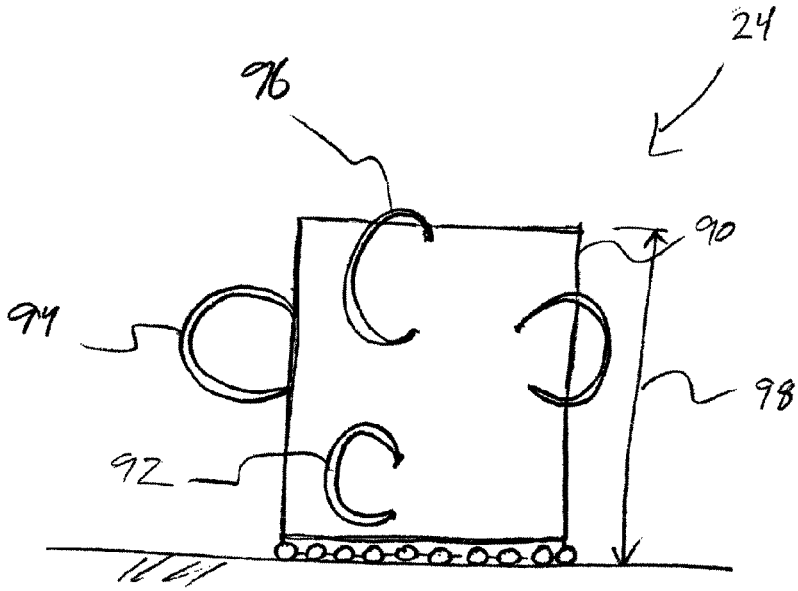
FIG. 7 is an elevational view of a practice body.

Players and or kids may wish to practice the spinning and launching action without actually playing against a competitor, thus developing the necessary skills for combat. For practice, a practice body 24 (as seen in FIG. 7) is provided. This particular practice body 24 has a plurality of targets arranged along its' outer surface at various elevations. Because the jousting bodies 22 have varying weapon heights depending on the chosen configuration, the practice body 24 has in this embodiment a first lower row of hoop targets 92, a second middle row of hoop targets 94, and a third top row of vertically aligned hoop targets 96. This embodiment of the practice body 24 has a cylindrically aligned body 90 which has a vertical height 98 to provide for the multi-leveled hoop target arrangement.

Figure 8:
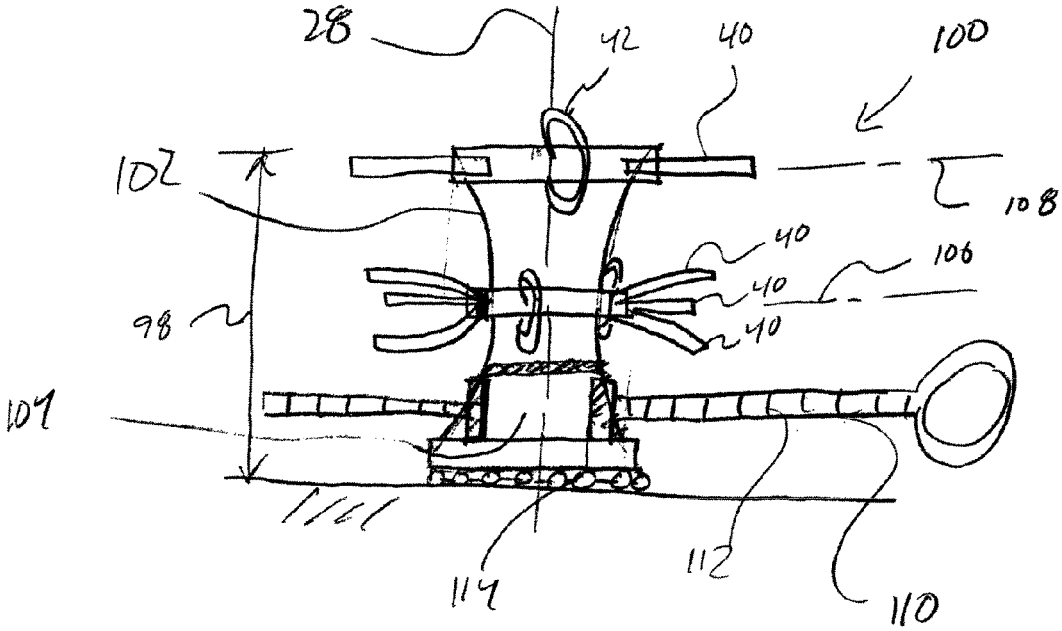
FIG. 8 is an elevational view of an alternative embodiment of a jousting element.

A third alternative embodiment to the jousting body 22 is shown in FIG. 8. This third embodiment is a multicomponent jousting body 100 which is configured in a cylindrical shape having an hourglass-type configuration. The multicomponent jousting body 100 has an elongated vertical height 98 to provide for in this particular embodiment, a first row of vertically aligned weapons 40 and targets 42 as well as a 2nd row 108 of vertically aligned weapons 40 and targets 42.

The weapons and targets are connected to an upper spinning section 102 which spins about the vertically aligned central axis 28 of the jousting body 100. Instead of providing torque or moment to the jousting body through the use of the player's hand, a pull cord 110 is provided to engage a spinning gear mechanism or gear element (not shown) within the jousting body 100. The spinning section 102 is mounted on a centrally aligned vertical axle with a cylindrical gear positioned at the base and arranged to engage the pull cords teeth 112. The pull cord is threaded through the pull ports 114 in the base section of the weapons and targets are connected to an upper spinning section 102 jousting body 100. The player holds the base section or travel base 104 and extracts the pull cord 110 which provides for moment about the centrally aligned vertical axis 28 thus spinning the upper spinning section 102 and rotating the weapons 40 and target elements 42. The player then pushes the jousting body 100 along the desired collision trajectory as previously discussed to either engage the practice body 24 or the opponent's jousting body during a jousting section.

Figure 9:
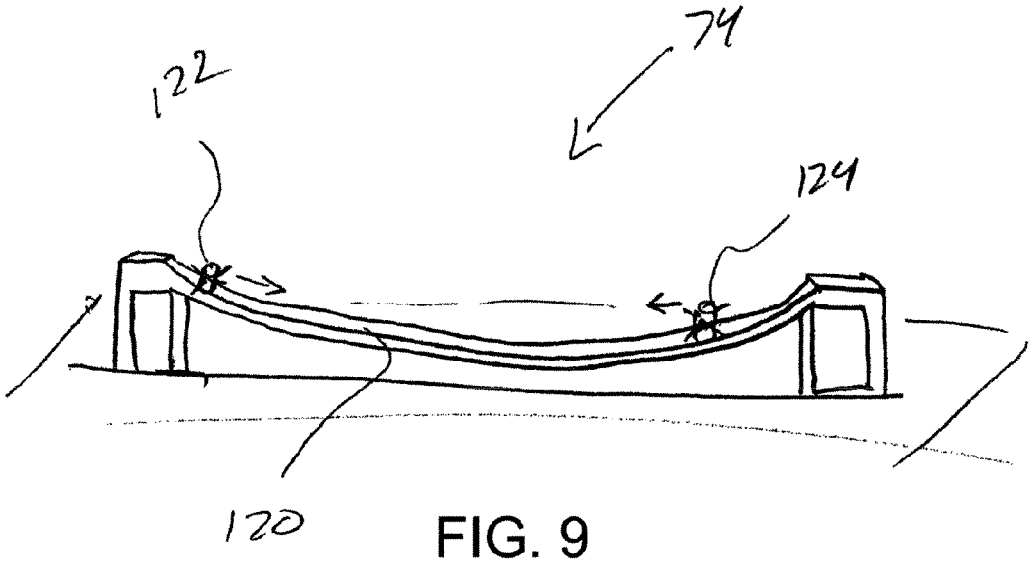
FIG. 9 is a perspective view of a jousting track with two jousting elements in a pre-engagement position.

As previously mentioned, the jousting elements 22, as seen in the first embodiment, are shown in combat colliding within a horizontal playing surface 20. An alternative embodiment to the playing surface, as seen in FIG. 9, is the use of a jousting track 120. The jousting track 120 in this second playing field embodiment is configured in a sagging arc with the end points of the arc at the higher elevation and the midpoint of the arc at the lowest elevation of the track. The jousting element opponents are placed at the end points of the track and the players then spin the jousting elements and launch them down the track towards one another. As seen in FIG. 9, the first jousting element 122 and the second jousting element 124 are each traveling down the track in a pre-engagement or pre-combat position.

Figure 10:
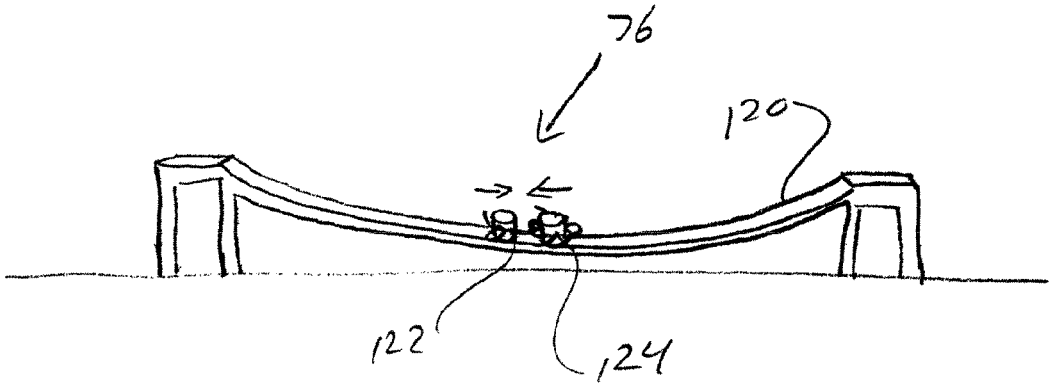
FIG. 10 is a perspective view of a jousting track with two jousting elements in an engagement position.

Referring to FIG. 10, the first jousting element 122 and the second jousting element 124 each collide with each other on the track at the lowest point on the track arc, either scoring points, losing points, or coming to a draw, depending on whether or not the weapon of one jousting element connects or hooks to the target of the other jousting element.

Figure 10A:
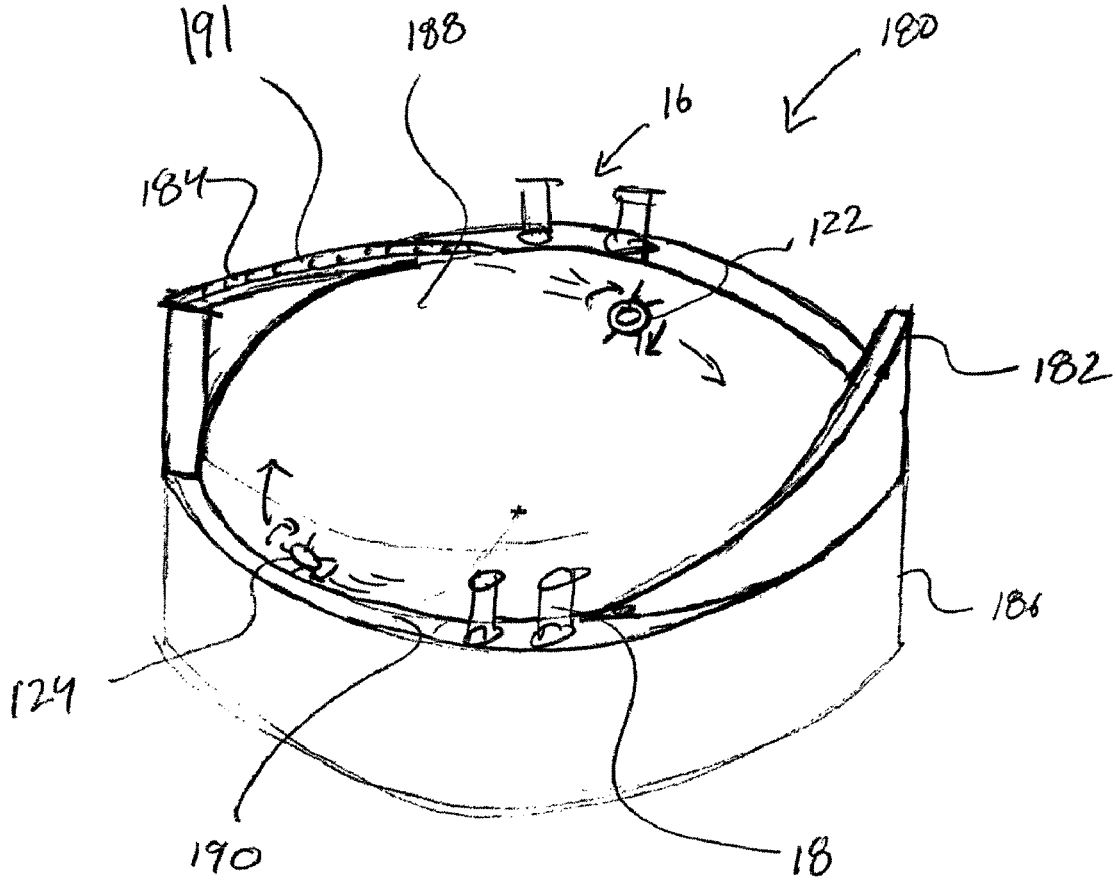
FIG. 10A is a perspective view of a combat arena.

In addition to the jousting elements colliding along a linear track, as previously mentioned in FIGS. 9 and 10, the jousting elements can be ejected into a combat arena 180 as seen in FIG. 10A. This particular combat arena 180 has a semispherical concave surface 188. The jousting elements or combat pieces are launched into the semispherical concave combat arena surface 188 through the use in this current embodiment of launching tracks including a first launching track 182 and a second launching track 184. The launching tracks have a spiral configuration which provide for a smooth transition from the horizontal launching arrangement to the inclined combat spiral trajectory within the semispherical arena. Also, the launching tracks 182 and 184 have in an alternative embodiment side rails with gear teeth 191, which mate with receiving teeth on the outer surface of the jousting elements to provide for centrifugal rotation about the vertically aligned centroid axis 28, as previously discussed. Thus the launching tracks 182 and 184 send the jousting elements, in this case a first jousting element 122 and a second jesting element 124, into the combat arena 180 spinning about their centroidal axes 28 as well as rotating about one another in a orbital-type manner within constantly eroding orbital radius until the jousting elements collide when the orbital radius between the two becomes so small that the weapon element 40 and the target element 42 of the respective jousting bodies collide or when the bodies themselves collide without scoring. The combat arena 180 has a cylindrically aligned set of arena walls 186 and the arena walls 186 have a top arena seating edge 190 to provide for each player's jousting team such as the first jousting team 16 to be placed on one side of the wall and the second jousting team 18 to be placed on the other side of the wall to watch the combat between two players.

Figure 10B:
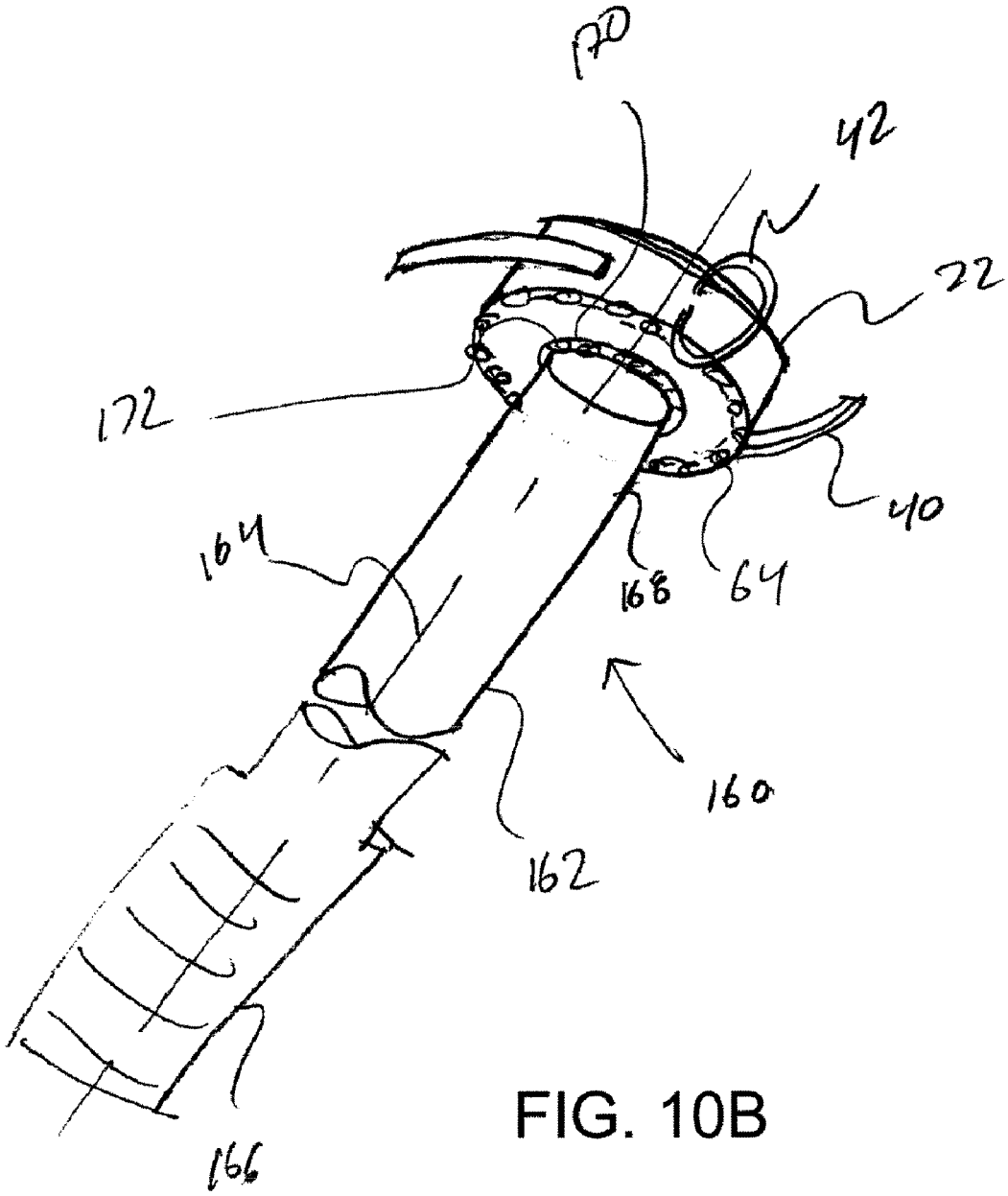
FIG. 10B is a perspective view of a jousting stick.

A third alternative embodiment to the playing field 20 includes the use of a jousting stick or sword 160 as seen in FIG. 10B. In this particular embodiment, the jousting body 22 is placed at the jousting element end 168 of the jousting stick 160. The stick itself is made of a stick cylindrical shaft 162 with a handle end 166 and the previously-mentioned jousting element end 168. To provide for rotation while sitting on the jousting end 168, the jousting element 22 has ring bearings 172 which are placed within the inner cylindrical edge of the jousting element or the inner ring 170. The players then spin the respective jousting bodies 22 at the end of the jousting sticks 160 and try to hook the weapon elements of the first jousting body 22 to the target element of a second jousting body. Thus the jousting elements 22 must be navigated and aligned in not only a two-dimensional but a three-dimensional spatial arrangement.

Figure 11:
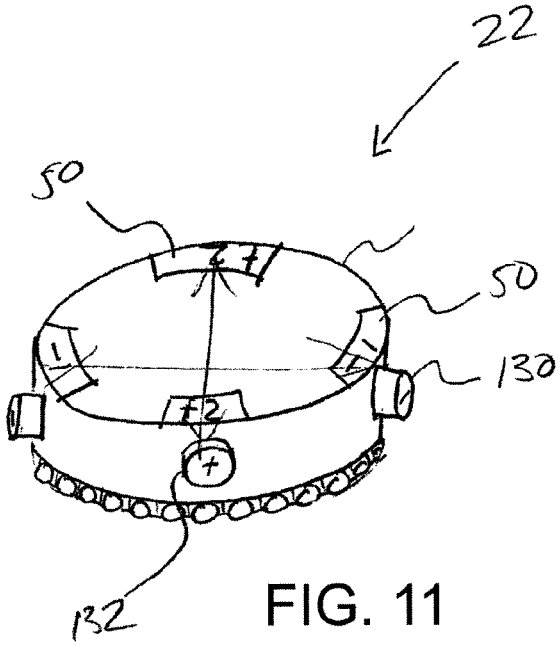
FIG. 11 is a perspective detail view of an alternative embodiment of a jousting element.

Referring to FIG. 11, a fourth alternative embodiment of the jousting element 22 is shown where the weapon element is a magnet 132 having a positive valence and the target element 130 is a magnet having a negative valence. The players spin and launch the, in this case, two cylindrical disc-shaped jousting elements towards one another on the playing field and the bodies collide, either connecting using the positive and negative magnet valences or they do not. If, for example, the bodies do connect using the magnets, the positive valence in this particular embodiment scores two points and the negative valence on the target element loses one point.

Figure 12:
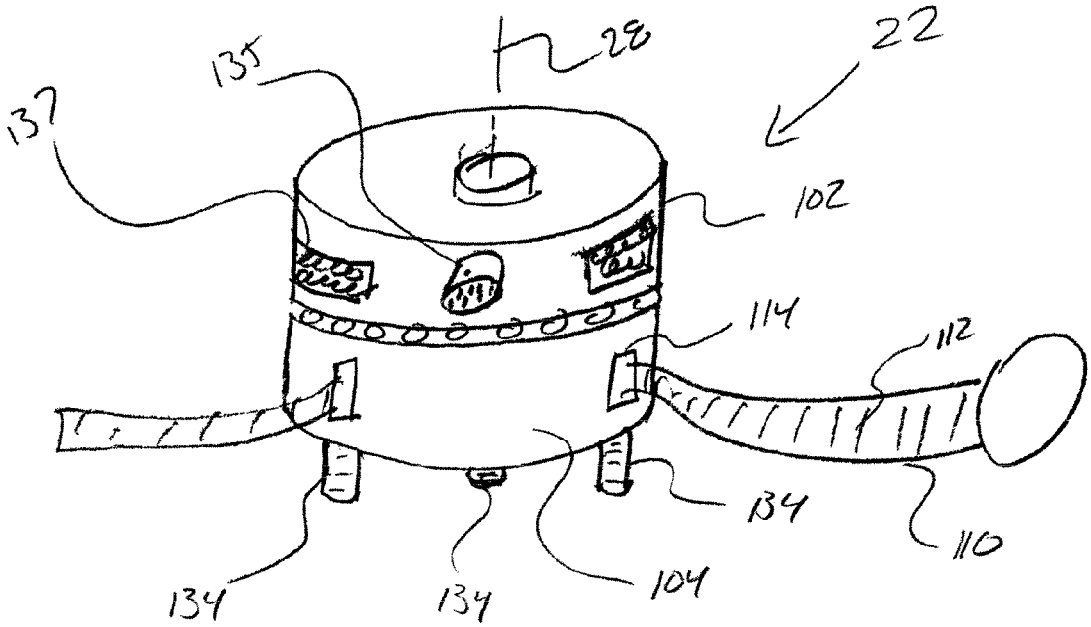
FIG. 12 is a perspective detail view of an alternative embodiment of a jousting element.

Referring to FIG. 12, a fifth alternative embodiment of the jousting body 22 is shown utilizing a pull cord 110 to spin the upper vertically aligned spinning section 102 similar to the previously mentioned multicomponent jousting element 100 (as seen in FIG. 8), but in this particular embodiment, the weapon element 135 is a hook fastener as utilized in the Velcro hook and loop-type arrangement, and the target element 137 is the loop faster of the Velcro hook and loop arrangement. While the upper vertically aligned spinning section 102 is rotated about the vertically aligned central axis 28, the travel base 104 in this fifth embodiment has longitudinally aligned travel wheels 134 which provide for straighter launching trajectory during jousting play.

Figure 13:
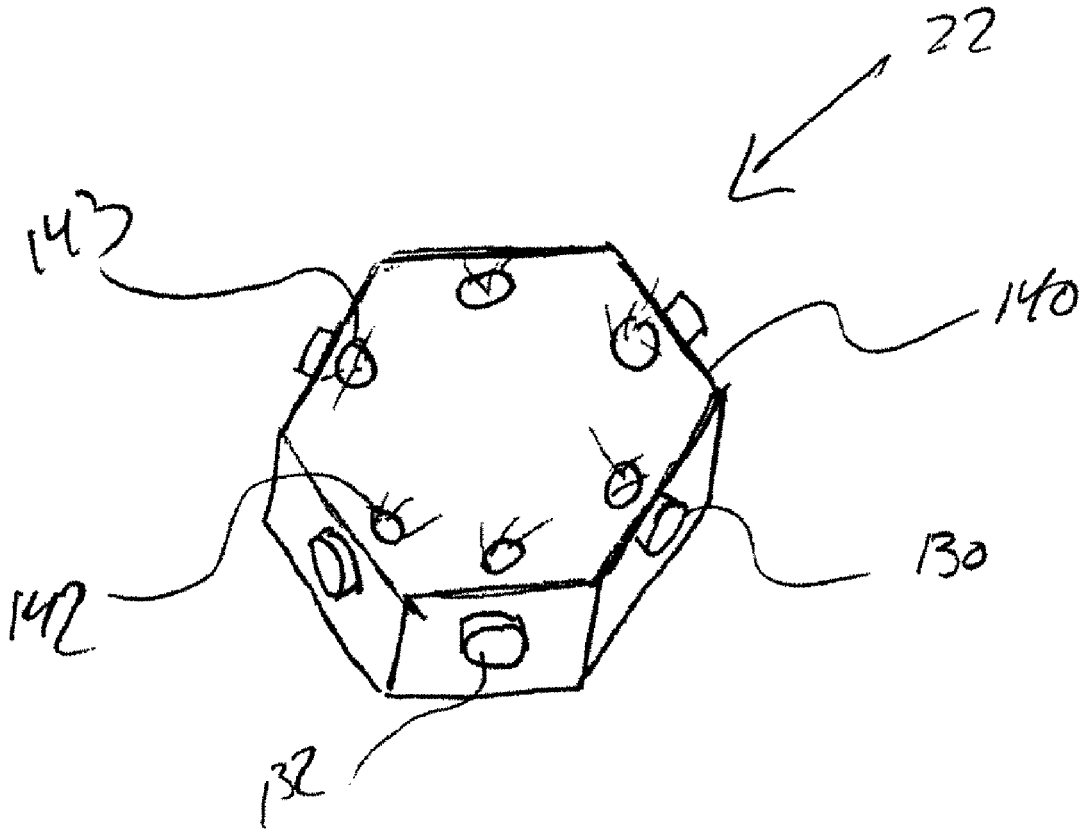
FIG. 13 is a perspective detail view of an alternative embodiment of a jousting element.

Referring to FIG. 13, a sixth alternative embodiment of the jousting element 22 is provided. The jousting element 22 has a plan view shaped in a hexagon body configuration 140 with each vertical surface having either a target element 130 or a weapon element 132. In this particular embodiment, the impact or connection of a target element 130 to a weapon element 132 on an opponent's jousting element will signal either a score LED 142 to light up or a detraction LED 143 to light up indicating the outcome of the jousting combat.

Figure 14:
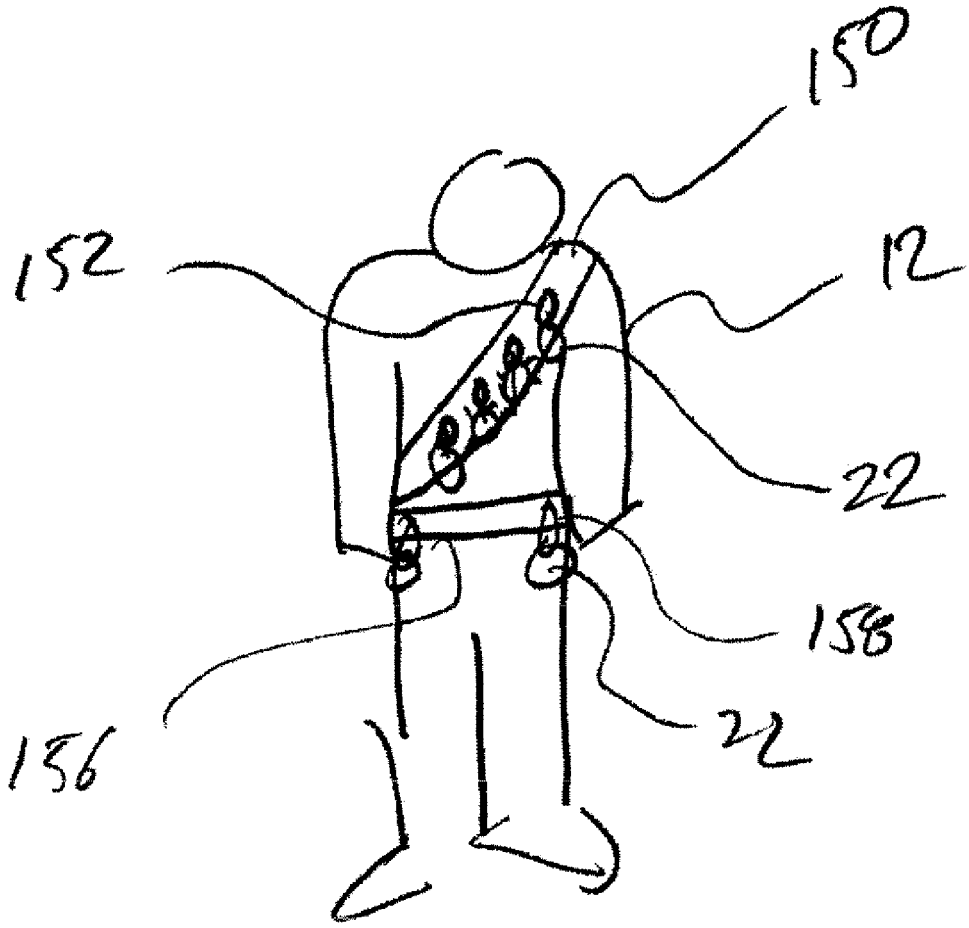
FIG. 14 is a schematic view of a jousting element sash and belt.

Referring to FIG. 14, the jousting elements 22 can be carried in a jousting team sash 150 on a player 12 or they can be carried on a belt 156 which is configured for carrying the jousting elements 22 on belt hooks 158. Other types of carrying cases can also be provided. These include boxes which have seats within the boxes for carrying the jousting elements as well as the various weaponry targets depending on the type of jousting elements.

Standard game play roles include the following scenarios. Referring back to FIG. 1, the first standard scenario is where each player starts with a team of figures. The players each select a figure to face-off. Players then spin and launch their jousting elements 22 towards the opponent. If one jousting element captures the other, or one gets an extension 40 through a ring 42, the players whose weapon caught the ring scores in this play, a value 50 of two points. If a weapon extension 40 falls off a jousting body 46 due to a collision, the opposing player scores in this case, a loss value 50 of one point. If the two pieces collide and neither is captured or disarmed, the two pieces are reset and another attempt is made at jousting. If the second jousting attempt results in a tie, the players go to a sudden death scenario. In sudden death, the losing player or the player determined to go first, slides his piece towards the opponent's now stationary piece. The stationary piece is positioned at least two feet away with a ring 42 facing the opponent. If the first player misses, the roles are switched. If neither wins in two rounds of sudden death, each player scores a point and the players move onto the next pair of jousting figures. The game is played to seven points or if the players determine a number of figures to use; the game is played when all figures have been used.

An alternative game play is one where there are fixed attack configurations. The attack arms cannot be detached from the jousting body, and each player scores 1 point for a capture and the game is played until one of the players reaches five points or all figures have been cycled through the process.

Other secondary type of play patterns include: a Red Rover-type play pattern where each player lines up a team 18 of six on the table. Players take turns rolling to attempt to capture one of the opponent's pieces. After each throw, the player's attacking piece is returned to the line.

Another secondary play pattern includes racing the jousting elements 22. This includes using a track 120 (FIGS. 9 and 10) where the players race and joust on a single track or around a looped track (not shown).

A pitch play pattern includes each player sliding a jousting element 22 piece from the same side and attempting to be the closest to the edge of the table or playing field 20 without failing off.

A defender-type play pattern includes a dummy element 24 or jousting element 22, placed on a sheet of paper. Each player takes a turn trying to slide another jousting element 22 onto the surface area of the paper. If a guardian (in this case either a dummy element 24 or a jousting element 22) intercepts the existing jousting element trying to enter onto the sheet of paper, that player loses points. If the players jousting element hooks onto another jousting element resident on the paper, or knocks the guardian off the paper, that player also loses points.

A king type of play pattern includes each player selecting a king piece (a jousting element 22 or dummy element 24). Players position their jousting elements 22 on the table. Each player takes turns sliding an element. Elements are captured as normal and captured elements are removed. A player wins when they capture the opponent's king.

Alternative embodiments include the attack arms 40 being either permanently attached or detachable; each jousting 46 can have an indentation ring on the top which allows for modification and addition of accessories.

The jousting elements 22 are also designed to glow in the dark, miniature figures can be attached to the top surface 47 of the jousting body 46, and customized stickers 44 can also be placed on the top face of the jousting body. The jousting body might be etched for various customizations, and the body may alternatively be made of metal in lieu of plastic.

As previously mentioned, game boards with particular pattern plays may be utilized for placement of the jousting elements 22, ramps 120 or tracks can be used to create specialized closed environment jousting combat scenarios, and carrying devices such as sashes, belts or cases can be used.

A preferred method for sliding the jousting elements across a table includes standing above the element and the table and forming a 90 degree angle with the player, the jouster and the target. Positioning a ring facing the player on the player's jouster and putting an index finger on the diametrically opposite ring, the ring furthermost from the player. The jousting element is pushed towards the target and the index finger on the ring is flicked towards the target to spin the jousting element and provide a reasonably straight trajectory towards the opposing target.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A jousting element for use in a game, said jousting element comprising:

a. a body section arranged about a centrally aligned vertical axis, said body section configured to rotate about said centrally aligned vertical axis and to be carried above a playing surface;

b. a traveling component to carry said body section, said traveling component connected to said body section and providing for multidirectional travel of said body section above said playing surface; said traveling component comprising a stable footing on said playing surface to maintain said body section in an upright position without the use of centrifugal force;

c. a first playing component interoperable with said body section, said first playing component configured to kinetically engage and form a scoring connection with a second playing component on a second jousting element.

2. The jousting element according to claim 1 wherein said traveling component further comprises:

a. a first group of bearings, said first group of bearings comprising a first bearing, a second bearing, and a third bearing;

b. said first group of bearings connected to said body section and interoperating with said playing surface at a first group of playing surface support locations;

c. said first group of playing surface support locations comprising: a first bearing support location correlated to said first bearing, a second bearing support location correlated to said second bearing, and a third bearing support location correlated to said third bearing;

d. said first group of bearings positioned to maintain said body section above said playing surface during said rotation of said body section about said centrally aligned vertical axis, and to provide for said multidirectional travel above said playing surface.

3. The jousting element according to claim 1 wherein said multidirectional travel of said body section above said playing surface further comprises an interception trajectory with said second jousting element.

4. The jousting element according to claim 1 wherein said first playing component further comprises a hooked arm; said second playing component further comprises: a wire frame hoop; said scoring connection comprising said hooked arm connecting to said wire frame hoop.

5. The jousting element according to claim 1 wherein said first playing component further a horizontally aligned shaft; said second playing component comprising a hinged target surface; said scoring connection comprising said horizontally aligned shaft compressing said hinged target surface.

6. The jousting element according to claim 1 wherein said jousting element further comprises: means for attaching and detaching said first playing component from said body section.

7. The jousting element according to claim 1 wherein said body section further comprises:

a. a cylindrical body comprising a cylindrical outer wall, a radially disposed cylindrical inner wall, a circular top surface, a ringed bottom surface;

b. said traveling component connected to said ringed bottom surface to provide for said multi directional travel along said playing surface.

8. The jousting element according to claim 1 wherein said traveling component further comprises: a first group of wheels comprising a first wheel, a second wheel, and a third wheel, said first group of wheels configured for said multidirectional travel along a playing surface.

9. The jousting element according to claim 1 wherein said body section further comprises at least one of the following volumetric shapes individually or in combination: semispherical, cubic, pyramidal or semi cylindrical.

10. The jousting element according to claim 7 wherein said cylindrical body further comprises:

a. an upper jousting section and a lower drive section, said upper jousting section and said lower drive section positioned along said centrally aligned vertical axis, b. both of said upper jousting section and said lower drive section configured to circumferentially pivot about said centrally aligned vertical axis independent of one another;

c. said upper jousting section maintaining said first playing, said lower drive section maintaining said traveling component, said lower drive section configured to provide axial drive to said traveling component.

11. The jousting element according to claim 10 wherein said lower drive section further comprises: a pull cord system to drive said traveling component.

12. The jousting element according to claim 7 wherein said circular top surface further comprises a first group of positive score fields and a first group of negative score fields.

13. The jousting element according to claim 4 wherein said first playing component further comprises: a hook and loop type fastener; said second playing component further comprises: a hook and loop type receiver; said scoring connection comprising said hook and loop type fastener connecting to said hook and loop type receiver.

14. The jousting element according to claim 5 wherein said first playing component further comprises: a positive valence magnet; said second playing component further comprises: a negative valence magnet; said scoring connection comprising said positive valence magnet connecting to said negative valence magnet.

15. The jousting element according to claim 7 wherein said top surface further comprises a figure element attached to said top surface.

16. The jousting element according to claim 1 wherein said playing surface comprises a concave shaped arena.

17. The jousting element according to claim 1 wherein said playing surface further comprises a track.

18. The jousting element according to claim 1 wherein said traveling component further comprises:

a. a longitudinally aligned cylindrical shaft, said cylindrical shaft comprising a handle portion and a body section engagement portion arranged at an opposing end of said handle portion, said body section interoperable with said body section engagement portion;

b. said longitudinally aligned cylindrical shaft further comprising a body section support position wherein said body section is seated on said body section engagement portion and said centrally aligned vertical axis is substantially aligned with said longitudinally aligned cylindrical shaft, said body section engagement portion configured to provide rotation of said body section about said centrally aligned vertical axis.

19. A jousting element for use in a game, said jousting element comprising:

a. a body section arranged about a centrally aligned vertical axis, said body section configured to rotate about said centrally aligned vertical axis and to be carried above a playing surface;

b. said body section further comprising: a cylindrical body comprising a cylindrical outer wall, a radially disposed cylindrical inner wall, a circular top surface, a ringed bottom surface;

c. a traveling component to carry said body section, said traveling component connected to said ringed bottom surface, said traveling component further comprising:

i a first group of bearings, said first group of bearings comprising a first bearing, a second bearing, and a third bearing;

ii. said first group of bearings interoperating with said playing surface at a first group of playing surface support locations;

iii. said first group of playing surface support locations comprising: a first bearing support location correlated to said first bearing, a second bearing support location correlated to said second bearing, and a third bearing support location correlated to said third bearing;

iv. said first group of bearings arranged to maintain said body section above said playing surface during said rotation of said body section about said centrally aligned vertical axis, and to provide for said multidirectional travel above said playing surface;

v. a stable footing on said playing surface to maintain said body section in an upright position without the use of centrifugal force;

d. a first playing component interoperable to kinetically engage with said body section, a second playing component interoperable with said body section; said first and second playing components configured to engage a second jousting element;

e. said first playing component further comprising a first weapon component, a first target element;

f. said second playing component further comprising a second weapon component, a second target element.

20. A jousting element for use in a game, said jousting element comprising:

a. a body section arranged about a centrally aligned vertical axis;

b. means for rotating said body section about said centrally aligned vertical axis;

c. means for carrying said body section above a playing surface;

d. means for providing a stable footing on said playing surface to maintain said body section in an upright position without the use of centrifugal force;

e. means for providing multidirectional travel of said body section above said playing surface;

f. means for kinetically engaging said first playing component with a second jousting element to form a scoring connection.

21. A jousting assembly, said jousting assembly comprising:

a. a first group of jousting elements and a second group of jousting elements, each of said groups of jousting elements comprising a plurality of jousting elements, each jousting element comprising:

i. a body section arranged about a centrally aligned vertical axis, said body section configured to rotate about said centrally aligned vertical axis and to be carried above a playing surface;

ii. a traveling component to carry said body section, said traveling component connected to said body section and providing for multidirectional travel of said body section above said playing surface; said traveling component comprising a stable footing on said playing surface to maintain said body section in an upright position without the use of centrifugal force;

iii. a first playing component interoperable with said body section, said playing component configured to kinetically engage and form a scoring connection with a second playing component on a second jousting element;

b. said first group of jousting elements arranged in opposition to said second group of jousting elements, said first group of jousting elements affiliated with a first player, said second group of jousting elements affiliated with a second player, said first player and said second player each, aligning said jousting element with said opposing jousting element, rotating said body section about said centrally aligned vertical axis, launching said jousting element above said playing surface along an interception trajectory with said the opposing jousting element.

* * * * *